US008196496B2

(12) United States Patent
Shih et al.

(10) Patent No.: US 8,196,496 B2
(45) Date of Patent: Jun. 12, 2012

(54) SCREWDRIVER

(75) Inventors: Chih-Kun Shih, Santa Clara, CA (US); Tian-Ping Xu, Shenzhen (CN); Fu-Chun Cheng, Shenzhen (CN); Xia-Gu Liao, Shenzhen (CN); Ren-Qiang Xiao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 312 days.

(21) Appl. No.: 12/566,218

(22) Filed: Sep. 24, 2009

(65) Prior Publication Data

US 2011/0011219 A1 Jan. 20, 2011

(30) Foreign Application Priority Data

Jul. 20, 2009 (CN) ..... 2009 1 0304547

(51) Int. Cl.
*B25B 23/10* (2006.01)
*B25B 23/02* (2006.01)

(52) U.S. Cl. ..... 81/451; 81/57.37; 81/453

(58) Field of Classification Search ..... 81/451–458, 81/57.37, 430–436, 125
See application file for complete search history.

(56) References Cited

U.S. PATENT DOCUMENTS 2,625,967 A * 1/1953 Stull ..... 81/453
3,298,410 A * 1/1967 Noboru ..... 81/458
3,930,808 A * 1/1976 Miller et al. ..... 81/433

* cited by examiner

*Primary Examiner* — Hadi Shakeri
(74) *Attorney, Agent, or Firm* — Altis Law Group, Inc.

(57) ABSTRACT

A screwdriver includes a locking member, a positioning member, a retaining member, and a rotatable member. The locking member defines a locking member hole therein. The positioning member is received in the locking member hole, and defines first and second positioning member holes. An angled surface is located between the first and second positioning member holes. The retaining member secures the positioning member to the locking member, and defines a retaining member hole to receive the positioning member. The rotatable member is received in the first positioning member hole, and slidable to abut the angled surface to slide the positioning member from a first position where the rotatable member is positioned in the first positioning member hole, to a second position where the rotatable member is positioned in the second positioning member hole so as to splay the second positioning member hole.

19 Claims, 6 Drawing Sheets

SCREWDRIVER

BACKGROUND

1. Technical Field

The present disclosure relates to fastener technology, and particularly to a screwdriver capable of fixing screws.

2. Description of Related Art

Screws are often used for mounting and fastening a wide array of device and apparatus elements. A screwdriver is required for engagement of the screws. However, when operated mechanically or robotically, the screwdriver frequently encounters difficulty in accurate alignment of screws.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
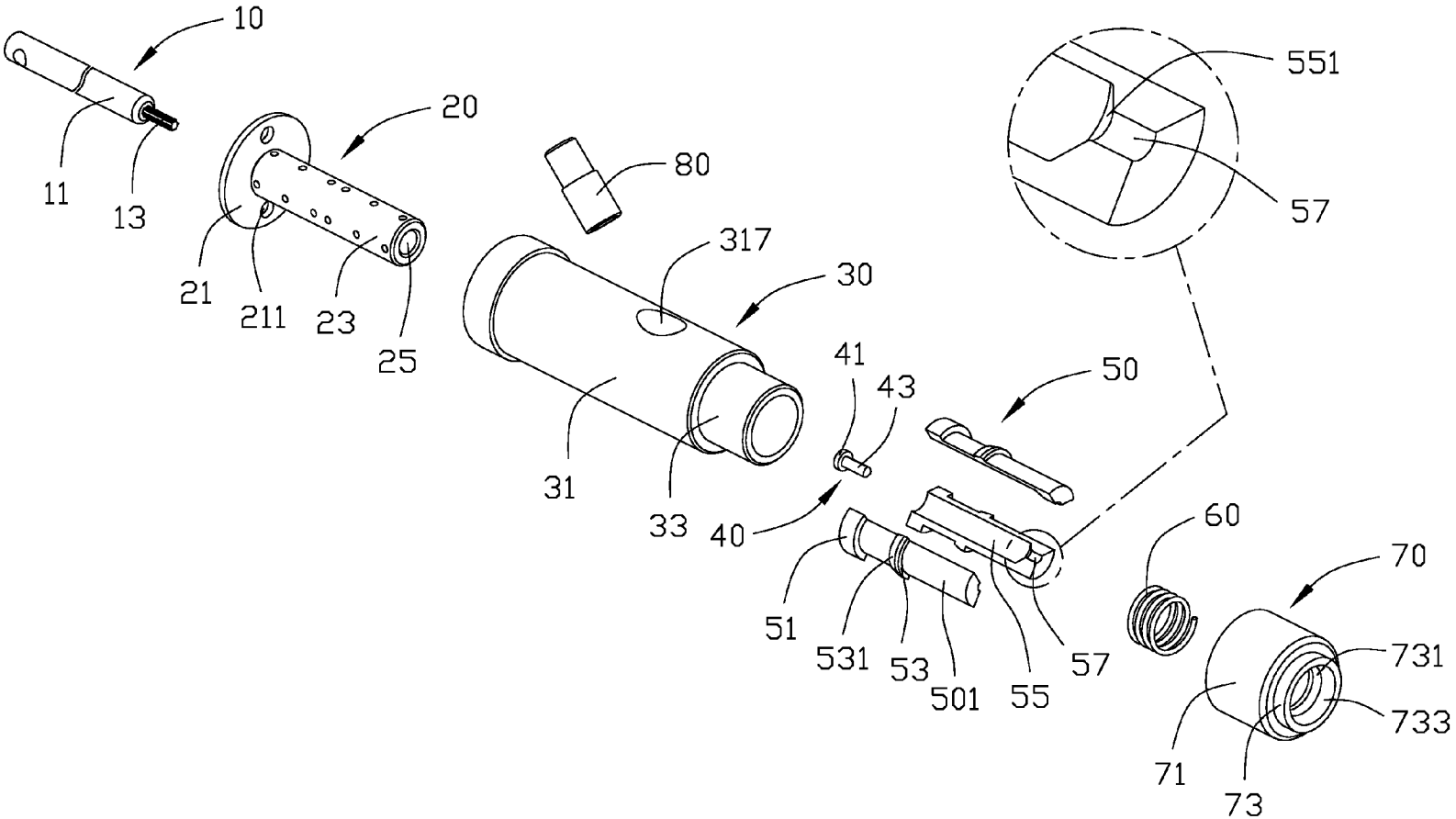
FIG. 1 is an exploded, isometric view of a screwdriver in accordance with an embodiment.

Referring to FIG. 1, a screwdriver in accordance with an embodiment includes a rotatable member 10, a mounting member 20, a locking member 30, a positioning member 50, a spring member 60, a retaining member 70, and a transmitting member 80.

The rotatable member 10 is rotatable when a turning force is applied thereon, and includes a base body 11, and a driver portion 13 extending from an end of the base body 11. The driver portion 13 has a smaller dimension than a diameter of the base body 11.

The mounting member 20 includes a mounting portion 21 and an extending portion 23 extending from the mounting portion 21. Two mounting holes 211 are defined in the mounting portion 21. A through hole 25 is defined in the mounting member 20 through the mounting portion 21 and the extending portion 23. The through hole 25 has a diameter substantially equaling the diameter of the base body 11 of the rotatable member 10.

Figure 2:
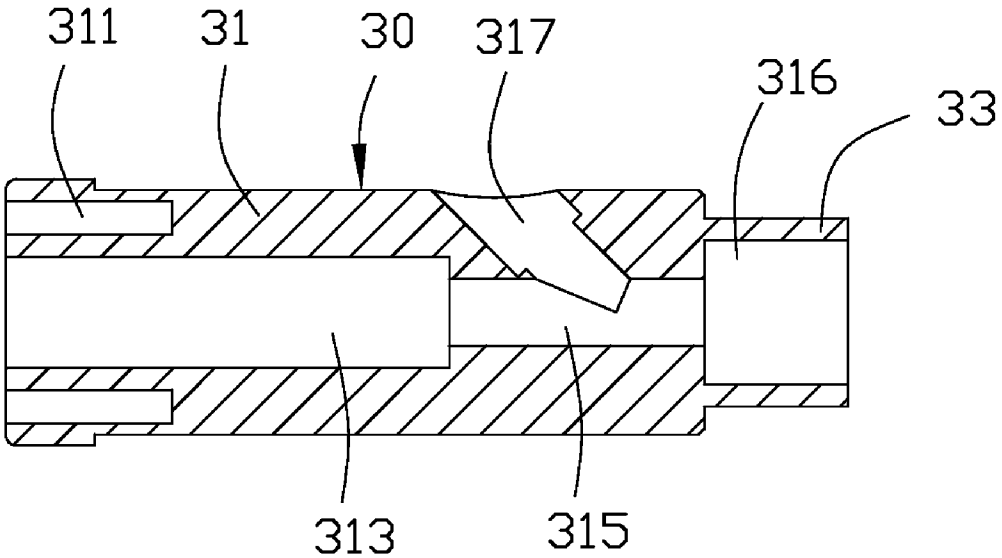
FIG. 2 is a cross-section view of a locking member of FIG. 1.

Referring also to FIG. 2, the locking member 30 includes a first locking portion 31 and a second locking portion 33 extending from the first locking portion 31. The first locking portion 31 has a diameter exceeding that of the second locking portion 33. Two securing holes 311 are defined in an end of the first locking portion 31. A first locking member hole 313, a second locking member hole 315, and a third locking member hole 316 are defined in the locking member 30. The first locking member hole 313 communicates with the second locking member hole 315, and has a diameter substantially equaling that of the extending portion 23 of the mounting member 20. The second locking member hole 315 has a diameter substantially equaling that of the through hole 25 of the mounting member 20. The third locking member hole 316 has a diameter exceeding that of the second locking member hole 315. A feeder hole 317 is defined in the second locking portion 33 to communicate with the second locking member hole 315, and is angled relative to an axis of the first locking member hole 313.

The positioning member 50 includes three separated positioning blocks 501. A positioning portion 51 is located on an outer surface of an end portion of the positioning member 50, and has a diameter less than that of the third locking member hole 315. A locating portion 53 is located on an outer surface of a middle portion of the positioning member 50. An angled surface 531, such as a conical surface, is located on the locating portion 53 at a side adjacent to the positioning portion 51. A first positioning member hole 55 and a second positioning member hole 57 are defined in the positioning member 50, and the first positioning member hole 55 communicates with the second positioning member hole 57. The first positioning member hole 55 has a diameter exceeding that of the second positioning member hole 57, and substantially equaling the diameter of the base body 11 of the rotatable member 10. An angled surface 551 is located on an inner surface of the first positioning member hole 55 adjacent to the second positioning member hole 57.

Figure 3:
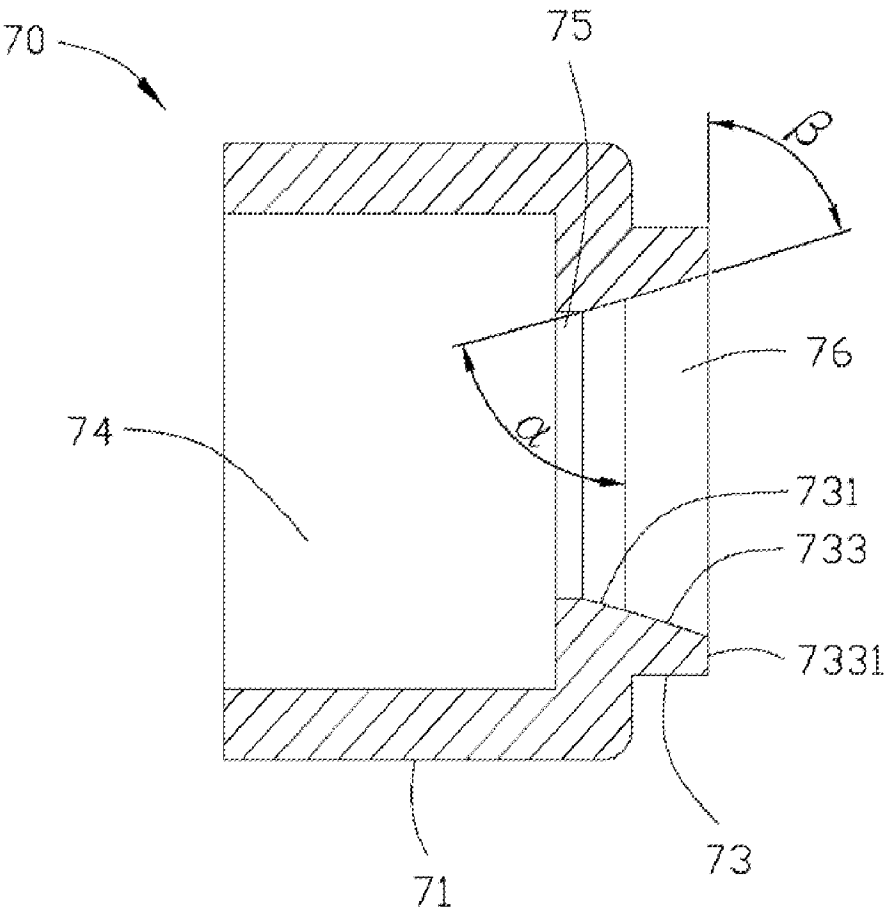
FIG. 3 is a cross-section of a retaining member of FIG. 1.

Referring also to FIG. 3, the retaining member 70 includes a first retaining portion 71, and a second retaining portion 73 having a diameter less than that of the first retaining portion 71. A first retaining member hole 74, a second retaining member hole 75, and a third retaining member hole 76 are defined in the retaining member 70. The first retaining member hole 74 has a diameter substantially equaling the diameter of the second locking portion 33 of the locking member 30. The second retaining member hole 75 has a diameter less than the diameter of the first retaining member hole 74, but substantially equaling the minimal diameter of the angled surface 531 of the locating portion 53 of the positioning member 50. The third retaining member hole 76 is conical, and has a minimum diameter equal to that of the second retaining member hole 75. In one embodiment, the inner surface of the third retaining member hole 76 includes a first portion and a second portion. In one embodiment, a first angle $\alpha$ is formed between the angled inner surface 731 of first portion of the third retaining member hole 76 and a vertical end surface 7331 of the retaining member 70 substantially perpendicular to an axis of the first retaining member hole 74. The first angle $\alpha$ may be 76°, for example. A second angle $\beta$ is formed between the angled inner surface 733 of second portion of the third retaining member hole 76 and the vertical end surface 7331, and is less than the first angle $\alpha$. The second angle $\beta$ may be 74°, for example.

The spring member 60 is resiliently deformable, and configured to surround the positioning member 50 between the positioning portion 51 and the locating portion 53. An outer diameter of the spring member 60 exceeds the second retaining member hole 75 of the retaining member 70, but less than that of the third locking member hole 316 of the locking member 30. The transmitting member 80 is configured to be received in the feeder hole 317 to transmit screws 40 to the locking member 30. Each screw 40 includes a head portion 41 and a threaded portion 43 extending from the head portion 41. The head portion 41 has a diameter less than that of the first positioning member hole 55 of the positioning member 50, and defines a slot (not shown) to receive the driver portion 13 of the rotatable member 10. The threaded portion 43 has a diameter less than that of the head portion 41, but equal to that of the second positioning member hole 57 of the positioning member 50.

Figure 4:
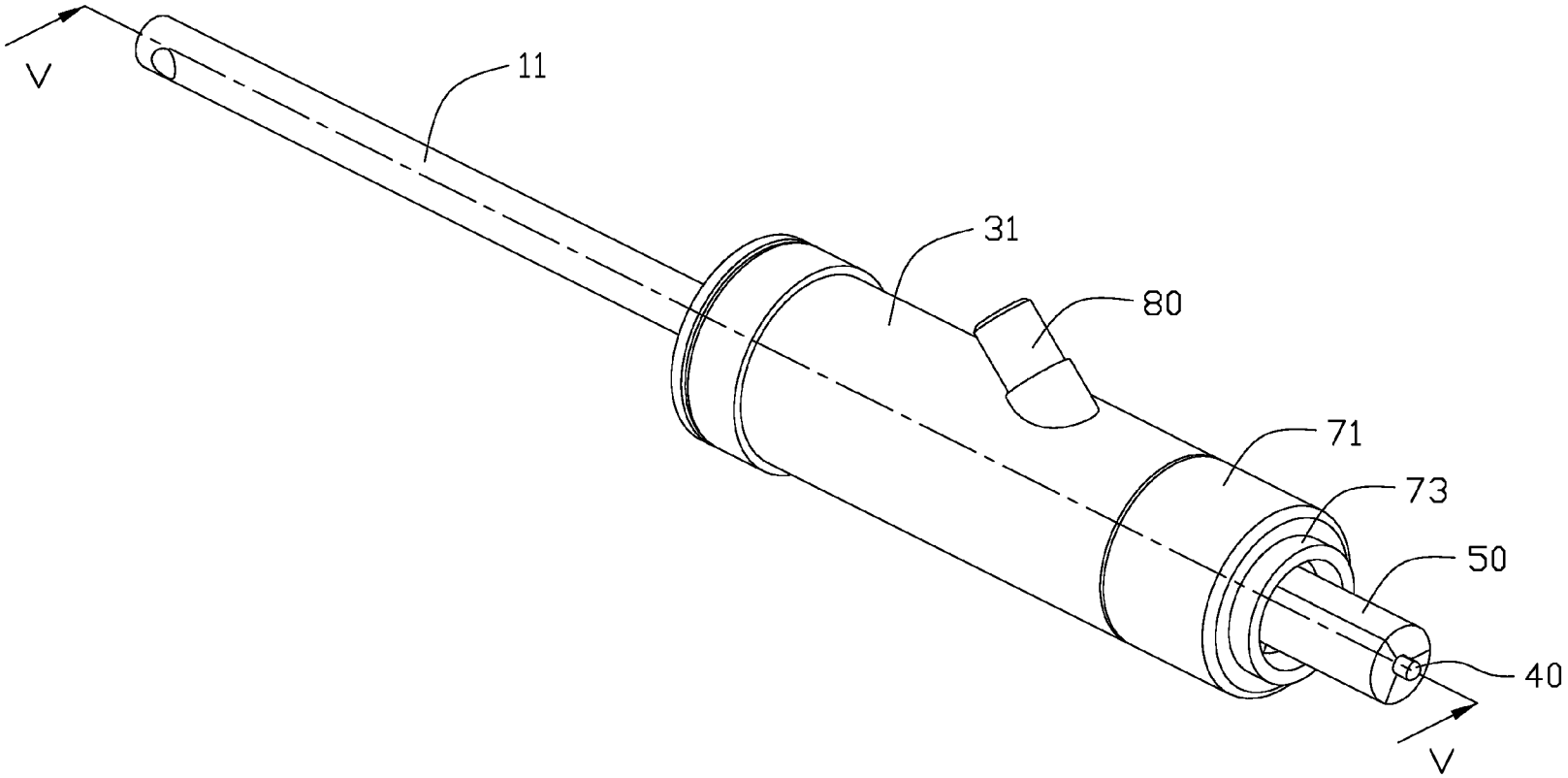
FIG. 4 is an assembled view of FIG. 1.
Figure 5:
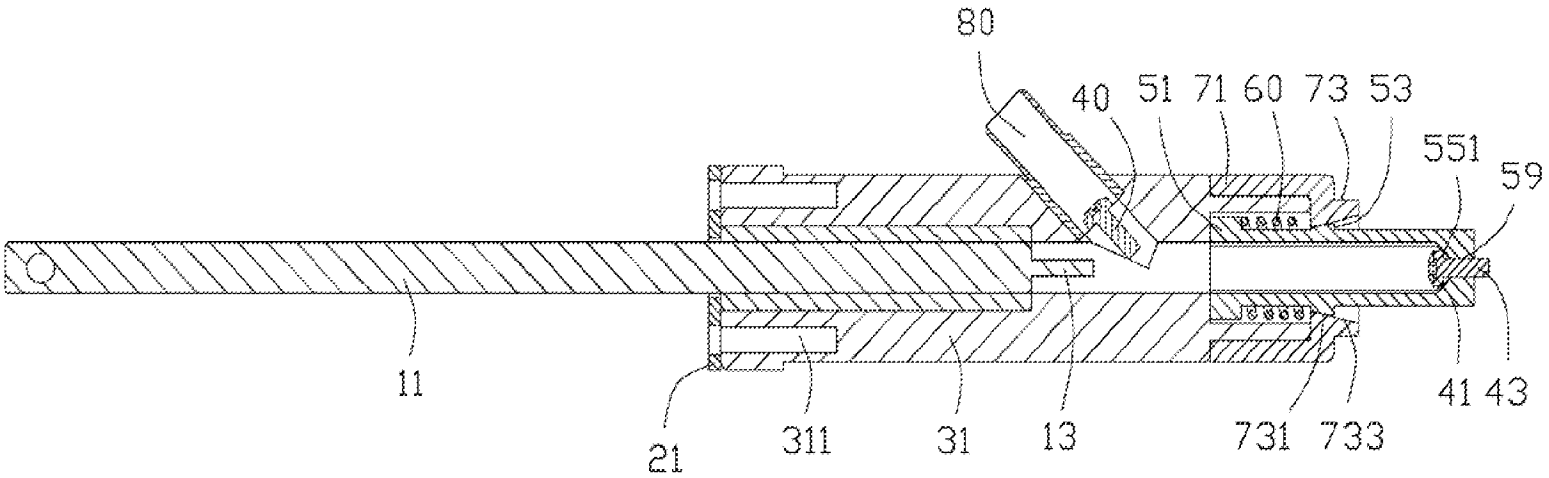
FIG. 5 is a cross-section of a retaining member of FIG. 4 along V-V direction.

Referring also to FIGS. 4-5, in assembly, the extending portion 23 of the mounting member 20 is received in the first locking member hole 313. The base body 21 abuts the end of the locking member 20, and the mounting holes 211 align with the securing holes 311 of the locking member 30. Two fasteners (not shown) are fixed in the mounting holes 211 and the securing holes 311 to secure the mounting member 20 to the locking member 30. The spring member 60 is located on the positioning member 50 between the positioning portion 51 and the locating portion 53, and the positioning member 50 is received in the retaining member 70. The positioning member 50 and the spring member 60 are positioned in the first retaining member hole 74, and the locating portion 53 is positioned in the third retaining member hole 76.

The retaining member 70, together with the positioning member and the spring member 60, is secured on the locking member 30. The second locking portion 33 is secured in the first retaining member hole 74. The positioning portion 51 of the positioning member 50 and the spring member 60 are positioned in the third locking member hole 316, and the first positioning member hole 55 aligns with the third locking member hole 316. The transmitting member 80 is received in the feeder hole 317 of the locking member 30, and the rotatable member 10 is received in the through hole 25 of the mounting member 20.

Figure 6:
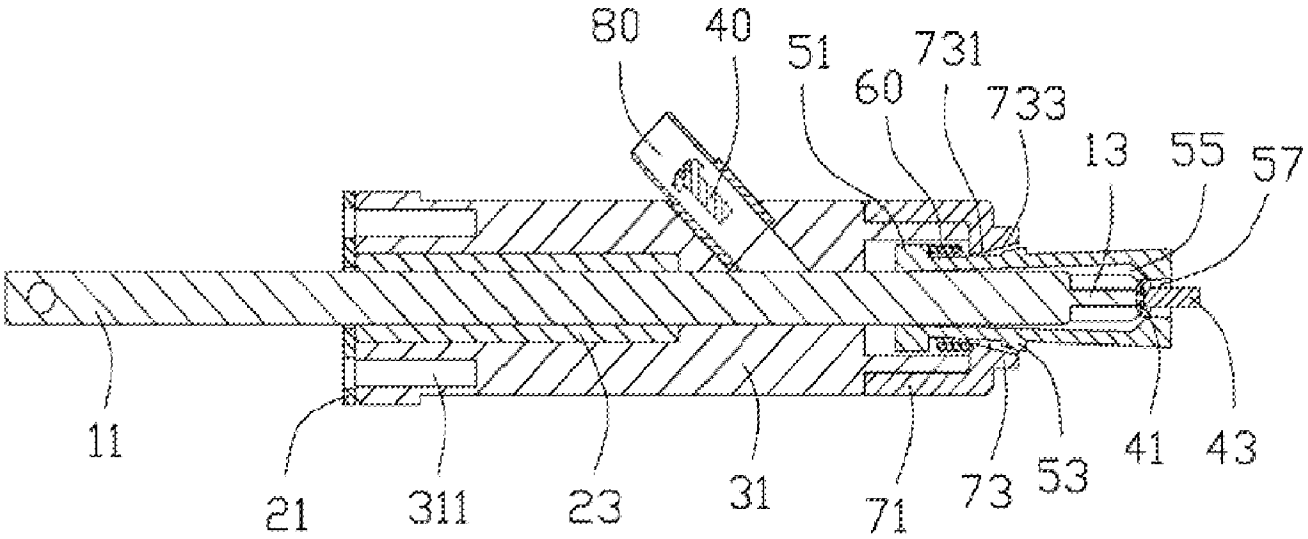
FIG. 6 is similar to FIG. 5, but shows the rotatable member engaging a screw.

Referring also to FIG. 6, in use, the transmitting member 80 transmits the screw 40, the threaded portion 43 of which towards the feeder hole 317. The screw 40 is pushed, for example by air, through the feeder hole 317, the second locking member hole 315, and the first positioning member hole 55 of the positioning member 50, until the threaded portion 43 is positioned in the second positioning member hole 57 and the head portion 41 abuts the angled surface 551. The rotatable member 10 is driven until the driver portion 13 engages the slot of the head portion 41 of the screw 40. Then the rotatable member 10 is further urged to push the screw 40. The angled surface 551 of the positioning member 50 is contacted by the head portion 41 of the screw 40, thereby sliding the positioning member 50 further out of the retaining member 70. At this time, the spring member 60 is resiliently deformed by the positioning portion 51. The locating portion 53 is slid from a position where the third retaining member hole 76 has a minimum diameter to a position where the third retaining member hole 76 has a maximum diameter. The positioning blocks 501 of the positioning member 50 are separated until the head portion 41 of the screw 40 can be slid through the third retaining member hole 76. Thus, the screw 40 can engage screw holes, and the rotatable member 10 is rotated to screw the screw 40 in the members to secure the members together.

It is to be understood, however, that even though numerous characteristics and advantages have been set forth in the foregoing description of embodiments, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A screwdriver comprising:

a locking member comprising a first locking portion and a second locking portion extending from the first locking portion; the first locking portion defining a first locking member hole therein; the second locking portion defining a second locking member hole communicating with the first locking member hole, a diameter of the first locking member hole being less than a diameter of the second locking member hole; a first resisting surface defined in the second locking member hole and connected to the first lock member hole;

a positioning member received in the second locking member hole, the positioning member comprising a positioning portion at an end of the positioning member; a diameter of the positioning portion being greater than the first locking member hole; the positioning member defining a first positioning member hole, a second positioning member hole, and an angled surface located between the first positioning member hole and the second positioning member hole;

a retaining member securing the positioning member to the locking member; the retaining member defining a first retaining member hole to receive the second locking portion and a second retaining member hole communicating with the first retaining member hole to receive the positioning member; a diameter of the second retaining member hole being less than a diameter of the first retaining member hole and the diameter of the positioning portion; a second resisting surface defined in the first retaining member hole and connected to the second retaining member hole; and a rotatable member slidable in the first positioning member hole;

wherein the positioning member is slidable between a first position where the rotatable member is positioned in the first positioning member hole, and a second position where the rotatable member is positioned in the second positioning member hole so as to splay the second positioning member hole; the rotatable member moves the positioning member from the first position to the second position by pushing the angled surface; and the positioning portion is disposed between the first resisting surface and the second resisting surface.

2. The screwdriver of claim 1, wherein the positioning member comprises three positioning blocks, and the three positioning blocks are configured to separate from each other to splay the second positioning member hole when the positioning member is in the second position.

3. The screwdriver of claim 1, wherein a spring member is located between the positioning portion and the second resisting surface; the spring member is deformed when the positioning member is slid from the first position to the second position.

4. The screwdriver of claim 1, wherein the retaining member further defines a third retaining member hole communicating with the second retaining member hole; the third retaining member hole has a minimum diameter and a maximum diameter; a locating portion is positioned in the third retaining member hole; the locating portion is slidable between a locating portion first position where the third retaining member hole has the minimum diameter, and a locating portion second position where the third retaining member hole has the maximum diameter.

5. The screwdriver of claim 4, wherein the locating portion is positioned in the locating portion second position when the second positioning member hole is splayed, and the locating portion is positioned in the locating portion first position when the second positioning member hole is resumed.

6. The screwdriver of claim 4, wherein an inner surface of the third retaining member hole is frusto-conical and located about the locating portion so as not to block the locating portion when the positioning member is in the second position.

7. The screwdriver of claim 6, wherein an inner surface of the third retaining member hole includes a first portion and a second portion; a first angle is formed between the inner surface of the first portion of the third retaining member hole and an end surface of the retaining member; a second angle is formed between the inner surface of the second portion of the third retaining member hole and the end surface of the retaining member; and the second angle is less than the first angle.

8. The screwdriver of claim 1, further comprising a mounting member, wherein the mounting member defines a through hole therein; the first locking portion further defines a third locking member hole therein communicating with the first locking member hole; the first locking member hole is disposed between the second locking member hole and the third locking member hole; a diameter of the first locking member hole being less than a diameter of the third locking member hole; the mounting member is received in the third locking member hole to enable the through hole to communicate with the first locking member hole; and the rotatable member is disposed in the through hole and the first locking member hole.

9. The screwdriver of claim 8, wherein the mounting member comprises a mounting portion and an extending portion extending from the mounting portion, the extending portion received in the third locking member hole; a diameter of the mounting portion being greater than a diameter of the extending portion; a mounting hole is defined in the mounting portion; and a securing hole is defined in the locking member corresponding to the mounting hole.

10. A screwdriver comprising:

a locking member defining a first locking member hole and a second locking member hole communicating with the first locking member hole therein; a diameter of the first locking member hole being greater than a diameter of the second locking member hole;

a mounting member received in the first locking member hole; the mounting member comprising a mounting portion and an extending portion extending from the mounting portion; a through hole defined in the mounting member through the mounting portion and the extending portion; a diameter of the through hole being substantially equal to a diameter of the second locking member hole;

a positioning member, the positioning member defining a first positioning member hole and a second positioning member hole, an angled surface located to connect an inner surface of the first positioning member hole with an inner surface of the second positioning member hole;

a retaining member securing the positioning member to the locking member, the retaining member defining a retaining member hole to receive the positioning member;

a rotatable member received in the through hole and the second locking member hole; the rotatable member slidable in the positioning member between a first position where the rotatable member is positioned in the first positioning member hole, and a second position where the rotatable member is positioned in a second positioning member hole to splay the second positioning member hole, wherein the angled surface of the positioning member is pushed by the rotatable member when the rotatable member is slid from the first position to the second position; and a spring member abutting on the positioning member and the retaining member; wherein the spring member is resiliently deformed when the rotatable member is in the second position, and biases the positioning member towards the first position.

11. The screwdriver of claim 10, wherein the positioning member comprises three positioning blocks, and the three positioning blocks are configured to separate from each other when the rotatable member is in the second position.

12. The screwdriver of claim 11, wherein the inner surface of the retaining member hole includes a first portion and a second portion connecting with the first portion; a first angle is formed between the inner surface of the first portion of the retaining member hole and an end surface of the retaining member; a second angle is formed between the inner surface of the second portion of the retaining member hole and the end surface of the retaining member; and the second angle is less than the first angle.

13. The screwdriver of claim 10, wherein a positioning portion is located on the positioning member, and the spring member is located on the positioning member between the positioning member and the positioning portion.

14. The screwdriver of claim 10, wherein the retaining member hole has a minimum diameter and a maximum diameter; a locating portion is positioned in the retaining member hole;

the locating portion is slidable between a locating portion first position where the retaining member hole has the minimum diameter, and a locating portion second position where the retaining member hole has the maximum diameter.

15. The screwdriver of claim 14, wherein the locating portion is positioned in the locating portion second position when the second positioning member hole is splayed, and the locating portion is positioned in the locating portion first position when the second positioning member hole is resumed.

16. The screwdriver of claim 14, wherein an inner surface of the retaining member hole is frusto-conical and located about the locating portion, so as not to block the locating portion when the second positioning member hole is splayed.

17. The screwdriver of claim 10, wherein the locking member defines a third locking member hole communicating with the second locking member hole therein; a diameter of the third locking member hole being greater than a diameter of the second locking member hole; and the positioning member is received in the third locking member hole.

18. The screwdriver of claim 17, wherein the retaining member defines a second retaining member hole communicating with the retaining member hole; a diameter of the second retaining member hole being greater than a diameter of the retaining member hole; the second retaining member receiving the locking member; a first resisting surface defined in the third locking member hole and connected to the second lock member hole; a second resisting surface defined in the second retaining member hole and connected to the first retaining member hole; and the spring member is disposed between the first resisting surface and the second resisting surface.

19. The screwdriver of claim 10, wherein a mounting hole is defined in the mounting portion; and a securing hole is defined in the locking member corresponding to the mounting hole.

* * * * *